United States Patent [19]

Hope

[11] 3,938,548

[45] Feb. 17, 1976

[54] FLUID FLOW CONTROL VALVES

[75] Inventor: Bernard Francis Hope, Birmingham, England

[73] Assignee: Coplastix Limited, England

[22] Filed: Apr. 16, 1974

[21] Appl. No.: 461,310

[30] Foreign Application Priority Data

May 2, 1973 United Kingdom ..... 20942/73

[52] U.S. Cl. ..... 137/527.8; 137/377

[51] Int. Cl.[2] ..... F16K 15/03

[58] Field of Search ..... 137/527, 527.2, 527.4, 137/527.6, 527.8, 525.3, 525.5, 525.7, 377, 382

[56] References Cited

UNITED STATES PATENTS

| | | | |
|---|---|---|---|
| 1,063,637 | 6/1913 | Barker | 137/527.8 X |
| 2,112,630 | 3/1938 | Marshall | 137/525.7 |
| 2,882,923 | 4/1959 | Smolensky | 137/527.8 X |
| 3,128,785 | 4/1964 | Krummel | 137/525.3 X |
| 3,292,658 | 12/1966 | Scaramucci | 137/525.3 |
| 3,613,720 | 10/1971 | Welch | 137/527.8 |
| 3,809,119 | 5/1974 | Cave | 137/527.6 X |

*Primary Examiner*—William R. Cline
*Attorney, Agent, or Firm*—Norris & Bateman

[57] ABSTRACT

A tidal flap valve adapted to be located in sea walls, storage tank walls or banks of tidal rivers or other water courses in which the liquid level varies, the valve comprising a flap or closure member supported on a frame by a flexible hinge, the frame defining an opening and adapted for attachment to a substantially vertical wall about an opening therein, the hinge being protected against damage by being disposed in a substantially enclosed space defined by a portion of the frame and a portion of the closure member.

12 Claims, 3 Drawing Figures

FLUID FLOW CONTROL VALVES

This invention relates to tidal flap valves of the kind usually comprising a flap or closure member hinged on a substantially vertical wall above an opening therein so that the flap lies over the opening. Although the term tidal flap valve is used herein to define and describe the invention, such valves may be located in sea walls, storage tank walls or banks of tidal rivers or other water courses in which the liquid level varies. The weight of the flap normally keeps it closed over the opening but should fluid pressure of, for example, sewage or other effluent, build up sufficiently in a passage leading to the opening to overcome the weight of the flap, then the latter opens under said fluid pressure and allows the effluent to escape. However, should a greater pressure be exerted on the outer side of the flap, for example, by a high tide, then the flap is closed firmly against the opening and fluid in the passage cannot escape until the pressures on both sides of the door are equalised, for example, when the tide ebbs.

One problem often experienced with such valves is that there is a tendency for the hinge arrangement above the flap to become corroded or damaged, thus rendering the valve inoperative, so that the flap may become jammed in a closed or partially open position. This can result in an excessive build-up of effluent in the passage with the flap closed, so that a sewer or sewers connected therewith become filled and overflow, or alternatively surging of fluid in the passage resulting from a reverse flow of water from the outer side of the valve into the passage when the flap is open.

Furthermore, it is common for such valves to suffer damage to the hinge arrangement as a result of vandalism.

It is of particular importance to ensure that the valve remains freely operable at all times to avoid the dangers to health which can be caused by an inadequate disposal of effluent.

It is therefore an object of the present invention to provide an improved tidal flap valve wherein the above mentioned problems are overcome or at least alleviated.

Thus, according to the present invention there is provided a tidal flap valve, comprising a frame defining an opening and adapted for attachment to a substantially vertical wall about an opening therein, and a closure member for said opening supported on said frame by a flexible hinge attached to said frame and said closure member, said hinge being disposed for protection against damage in a substantially enclosed space defined at least by a portion of said frame and a portion of said closure member.

Preferably said hinge is so attached to said frame and said closure member as to provide at least two fulcrum points about which said closure member is arranged to pivot relative to said frame.

An embodiment of the invention will now be described, by way of example only, with reference to the accompanying drawings, in which.

Figure 1:
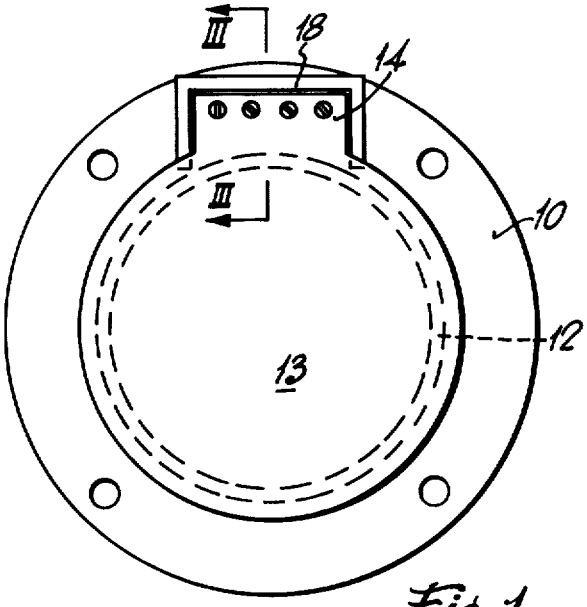
FIG. 1 is a front elevation of a tidal flap valve made in accordance with the invention.
Figure 2:
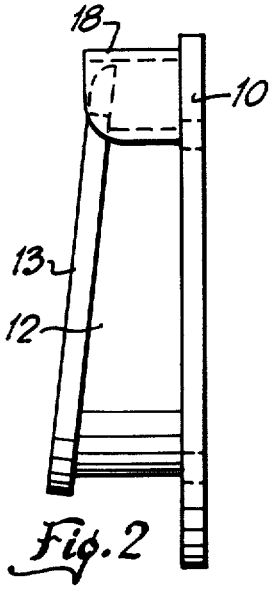
FIG. 2 is a side elevation thereof.
Figure 3:
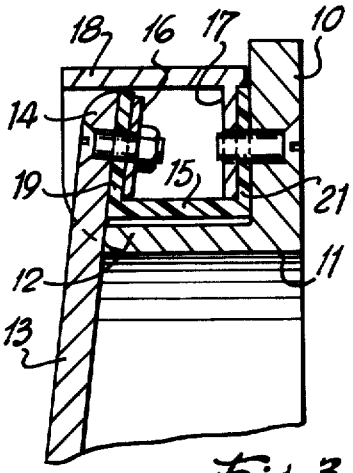

and FIG. 3 is an enlarged vertical section taken on line III—III of FIG. 1.

The flap valve generally comprises a frame having an opening therein, and a flap hinged to the frame and adapted to close the opening and a passage about which the frame is adapted to be secured, with the opening in alignment with the passage and the hinged portion above the opening, out of which passage effluent may flow through the opening to a region containing a liquid the level of which varies, the opening being disposed below the highest level reached by the liquid, at a desired height above an average level of the liquid in said region.

More particularly, and with reference to the drawings, the valve comprises an annular frame 10 made of a suitable plastics material, having a central opening 11 and an axially extending preferably integral tubular member 12.

A circular flap 13 is hingedly attached, as will be further described, to the frame 10 above the opening 11 so that in its lowermost position it is arranged to cover the open end of the tubular member 12, thus completely to occlude the opening 11. The open end of the member 12 is so arranged that when the frame is secured to a vertical wall it presents a seating for the flap, which is inclined outwardly and downwardly so that the weight of the flap assists in keeping it firmly seated in a closed condition.

The flap 13 has a radial extension 14 in one circumferential region. Bolted to said extension 14 on the side thereof adjacent the frame is one leg 19 of a U-shaped flexible hinge member 15, the other leg 20 of which is bolted to the frame. A rigid backing strip 16 ensures a firm attachment of the hinge member 15 to the flap 13. A similar backing strip 17 is provided for attachment of the hinge member 15 to the frame 10, said strip 17 being integral with a casing member 18 having a top wall and two side walls which extend outwardly from the frame 10 in a direction parallel to the axis of the tubular member 12 to a position substantially aligned with said flap, and which form a casing around said radial extension of said flap. As shown in the drawing casing member 18 and the flap extension 14 effectively combine to protectively enclose the flexible hinge.

The frame 10 including the tubular member 12 is preferably moulded from rigid PVC. The flap 13 may be of asbestos-impregnated PVC or any other material selected for its strength properties. The hinge member 15 is of a flexible plastics material having corrosion resistant properties such as polyurethane, and the casing member 18, its integral backing strip 17 and the backing strip 16 may be of a suitable non-corrosive metal, or rigid plastics material. It will be understood that the material or materials from which the various parts of the valve are formed will be selected in accordance with the conditions which they must withstand in use.

In use, the flap 13 is normally maintained in a closed position by its own weight. When there is a sufficient build-up of fluid pressure in the passage leading to the valve the flap 13 is caused to open to allow fluid to escape to the region outside of the valve. When the fluid pressure behind the flap is insufficient to open same, or when there is a greater pressure of fluid on the other side of the flap, for example when the water level outside the valve is above the latter, the flap is maintained in its closed position, thus preventing escape of fluid from the passage.

The flexible hinge member 15 provides two fulcrum points, one at the base of each leg, so that the flap may pivot about a general locality defined by the hinge member as a whole.

As the hinge member 15 is substantially enclosed by the flap 13, the frame 10 and the casing member 18, it is protected against damage by natural causes and is inaccessible, thus to prevent wilful damage as a result of vandalism. There is a small clearance between the base of the side walls of the casing member 18 and the outer surface of the tubular member 12, thus allowing escape of water from the area within the casing member.

It will be appreciated that the specific gravity of the flap is arranged to be greater than that of the liquid in the region outside of the valve, and is preferably arranged to have a ratio of between 1.03 and 2.00.

It is not intended to limit the invention to the above example only, many variations such as might readily occur to one skilled in the art being possible without departing from the scope of the invention.

For example, although the valve has been described as being generally circular in form the actual shape is a matter of choice in accordance with the particular application of the valve.

Furthermore, if required the flap may be other than a one-piece construction and may include two or more different materials so assembled that the overall specific gravity of the flap may be selected in accordance with the conditions of use.

What is claimed is:

1. A tidal flap valve comprising a frame defining a flow opening and adapted to be fixedly mounted over a registering opening in a substantially vertical wall, a closure member for said flow opening, a flexible hinge interconnecting an upper part of said closure member to said frame at an upper part of said flow opening, and a casing member projecting from said frame at said hinge, said frame and casing members and the upper portion of said closure member being cooperatively formed for defining a substantially enclosed space wherein said hinge is disposed for protection against damage and undesired access while permitting operational movement of said closure member about said hinge.

2. A tidal flap valve according to claim 1, wherein said hinge is so attached to said frame and said closure member as to provide at least two fulcrum points about which said closure member is arranged to pivot relative to said frame.

3. A tidal flap valve according to claim 1, wherein said frame has an axially projecting tubular portion at said flow opening, the upper part of said tubular portion being disposed below and adjacent said hinge.

4. A tidal flap valve according to claim 3, wherein said tubular portion is formed integrally with said frame.

5. A tidal flap valve according to claim 3, wherein the outer end of said tubular portion is inclined such that said tubular portion tapers towards said hinge.

6. A tidal flap valve according to claim 3, wherein said closure member closes against the outer open end of said tubular portion to close said flow opening.

7. A tidal flap valve according to claim 1, wherein said hinge comprises a flexible U-shaped element, and means is provided whereby the legs of said element are secured respectively to said frame and said closure member.

8. A tidal flap valve according to claim 1, wherein said casing member has a top wall and two side walls extending outwardly from said frame to cover a portion of said closure member and the upper part of said closure member extends between said side walls.

9. A tidal flap valve according to claim 1, wherein said closure member has an extension disposed within said casing member, means securing a portion of said hinge to said extension, and means securing a further portion of said hinge to an adjacent region of said frame.

10. A tidal flap valve according to claim 1, wherein said frame is of a rigid plastics material.

11. A tidal flap valve according to claim 1, wherein said closure member is of asbestos-impregnated polyvinylchloride.

12. A tidal flap valve according to claim 1, wherein said hinge is of a flexible plastics material.

* * * * *